United States Patent [19]

Roland

[11] Patent Number: 4,867,327

[45] Date of Patent: Sep. 19, 1989

[54] KNOCK DOWN BOX

[76] Inventor: Billy F. Roland, 37805 Maple Hill, Mt. Clemens, Mich. 48043

[21] Appl. No.: 96,928

[22] Filed: Sep. 15, 1987

Related U.S. Application Data

[60] Division of Ser. No. 899,754, Aug. 21, 1986, abandoned, which is a continuation of Ser. No. 645,790, Aug. 30, 1984, abandoned, which is a continuation of Ser. No. 308,918, Aug. 5, 1981, Pat. No. 4,509,794, which is a continuation-in-part of Ser. No. 125,961, Feb. 29, 1980, Pat. No. 4,348,052.

[51] Int. Cl.[4] ..... B65D 8/14; B65D 43/02

[52] U.S. Cl. ..... 217/12 R; 217/57; 217/65; 220/4 F; 229/23 R

[58] Field of Search ..... 220/4 F; 217/12 R, 57, 217/62, 65; 229/23 R, 23 A

[56] References Cited

U.S. PATENT DOCUMENTS

| | | | |
|---|---|---|---|
| D. 212,601 | 11/1968 | Rubenstein . | |
| D. 289,234 | 4/1987 | Hoult . | |
| 801,113 | 10/1905 | Sisley | 217/12 R |
| 953,315 | 3/1910 | Boenker . | |
| 1,061,297 | 5/1913 | Johnson | 217/12 R |
| 1,209,027 | 12/1916 | Quade | 217/12 R |
| 1,255,406 | 2/1918 | Gilbert . | |
| 1,747,900 | 2/1930 | Jenny . | |
| 1,923,881 | 8/1933 | Palais | 217/12 R |
| 2,109,636 | 3/1938 | Foss | 229/23 R |
| 2,186,111 | 1/1940 | Kavanaugh | 229/23 A |
| 2,279,864 | 4/1942 | Eide . | |
| 2,347,821 | 5/1944 | Goldner . | |
| 2,486,987 | 11/1949 | Scarlett . | |
| 2,710,053 | 6/1955 | Hamilton . | |
| 2,723,788 | 11/1955 | Lund . | |
| 2,787,382 | 4/1957 | Williams . | |
| 2,956,766 | 10/1960 | Glassi . | |
| 3,054,484 | 9/1962 | Griffiths et al. . | |
| 3,234,908 | 2/1966 | Doskocil . | |
| 3,527,497 | 9/1970 | Self . | |
| 3,845,988 | 11/1974 | Fleisch et al. . | |
| 3,870,366 | 3/1975 | Rogers . | |
| 4,062,589 | 12/1977 | Klein et al. . | |
| 4,091,746 | 5/1978 | Kimbrough . | |
| 4,140,065 | 2/1979 | Chacon . | |
| 4,225,202 | 9/1980 | Chandler . | |
| 4,348,052 | 9/1982 | Roland . | |
| 4,357,993 | 11/1982 | Halpern et al. . | |
| 4,406,374 | 9/1983 | Yedor . | |
| 4,419,028 | 12/1983 | Roland . | |
| 4,509,794 | 4/1985 | Roland . | |

FOREIGN PATENT DOCUMENTS

| | | | |
|---|---|---|---|
| 4808/31 | of 0000 | Australia | 217/12 R |
| 24344 | of 1906 | Australia | 229/23 R |
| 2900117 | 7/1979 | Fed. Rep. of Germany . | |
| 43917 | 3/1971 | Finland . | |
| 558741 | 9/1923 | France | 217/12 R |
| 501326 | 2/1939 | United Kingdom . | |
| 678534 | 6/1950 | United Kingdom | 217/12 R |

*Primary Examiner*—George E. Lowrance
*Attorney, Agent, or Firm*—Basile and Hanlon

[57] ABSTRACT

A joint for assembling planar members of a knock down chair and a box made from an assembly of interlocking pieces requiring no fasteners is disclosed. The various members can be made from a single sheet of commercially available plywood. When the last planar member is assembled in place the other planar members remain assembled in interlocking relationship preventing unintended disassembly.

7 Claims, 3 Drawing Sheets

Fig-4
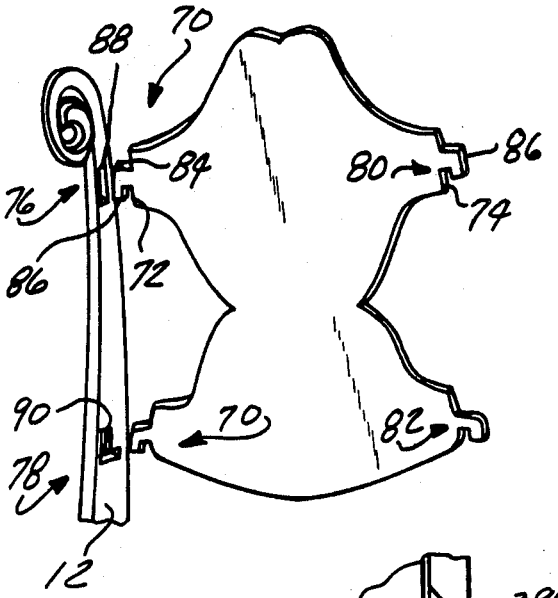
Fig-7
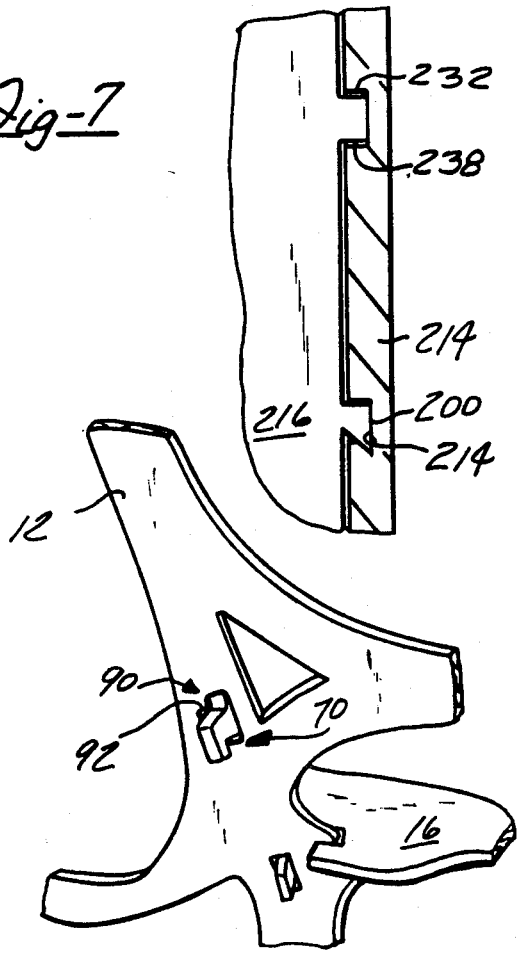
Fig-8
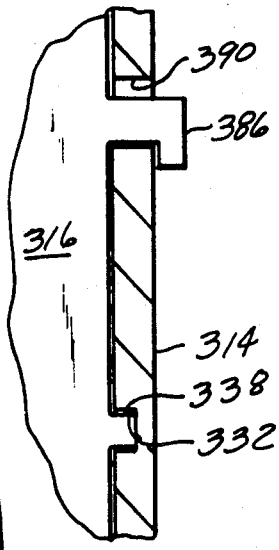
Fig-5
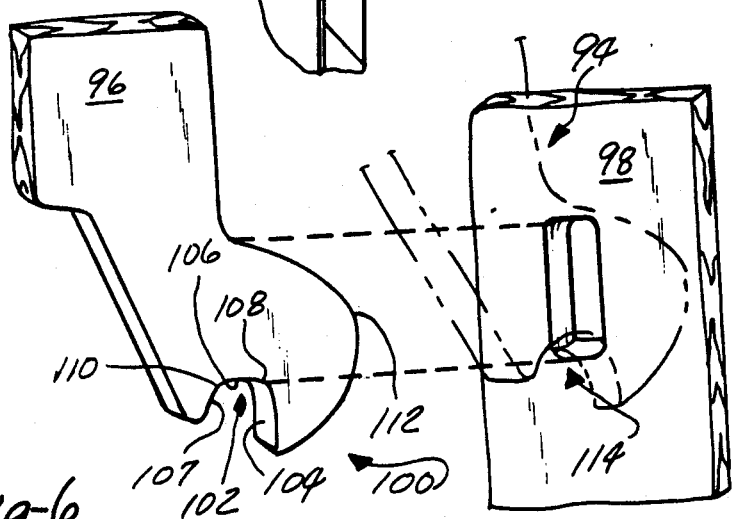
Fig-6
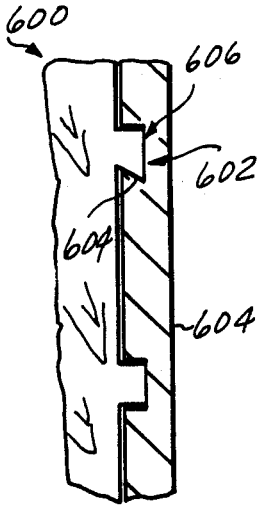
Fig-13

Fig-11
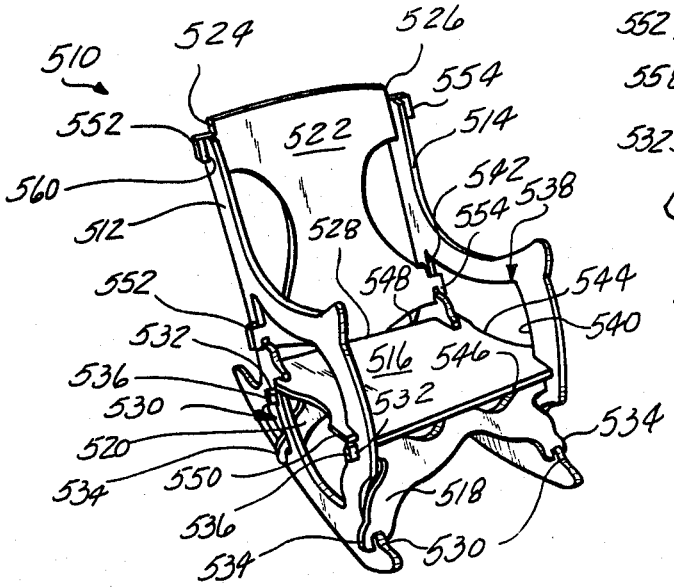
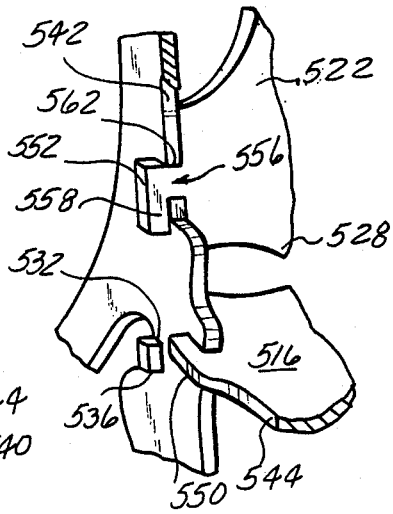
Fig-12
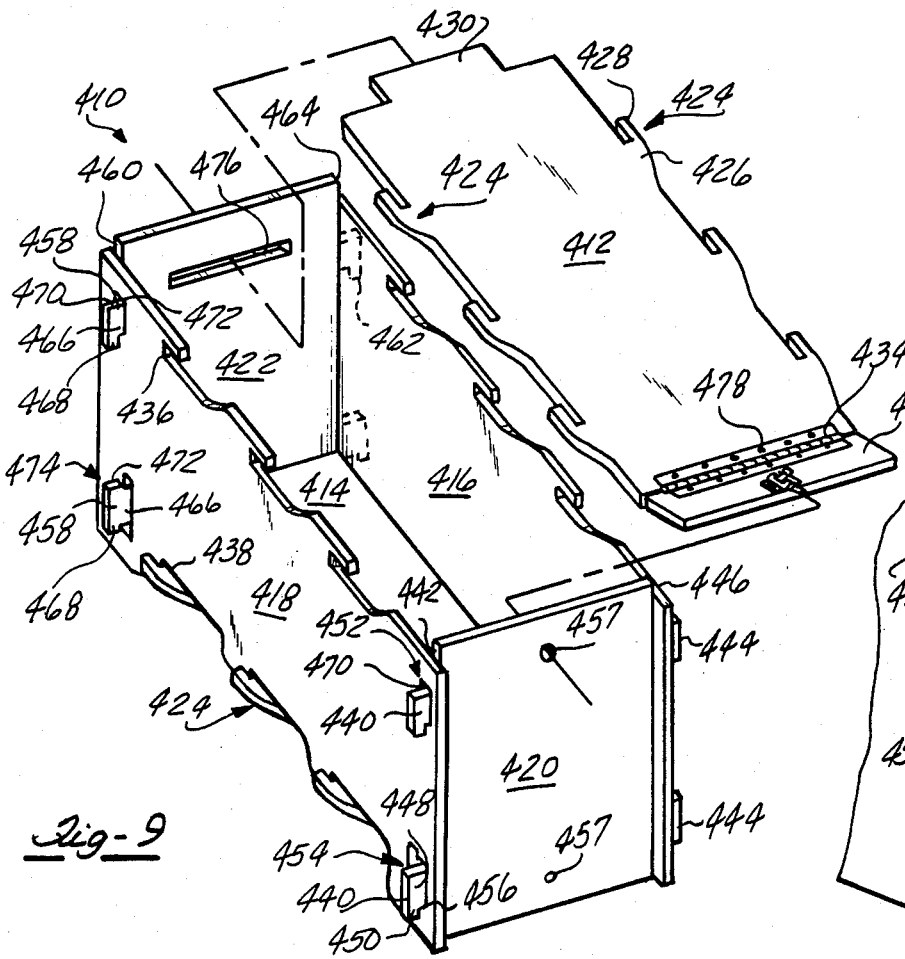
Fig-9
Fig-10
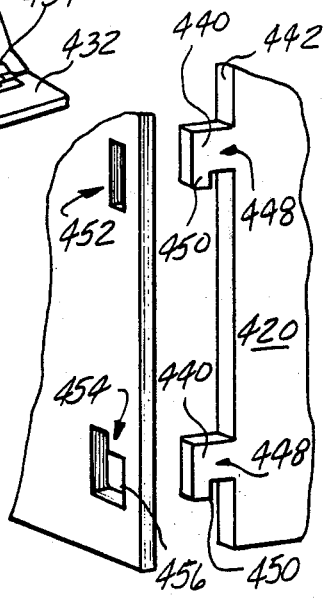

KNOCK DOWN BOX

CROSS REFERENCE TO RELATED APPLICATIONS

This application is a divisional of application Ser. No. 899,754 filed Aug. 21, 1986 now abandoned, which was a continuation of application Ser. No. 645,790 filed Aug. 30, 1984 now abandoned, which was a continuation of application Ser. No. 308,918 filed Oct. 5, 1981 entitled "PLANAR MEMBER JOINT" now U.S. Pat. No. 4,509,794, which was a continuation-in-part of application Ser. No. 125,961 filed Feb. 29, 1980 entitled "KNOCK DOWN CHAIR" now U.S. Pat. No. 4,348,052.

BACKGROUND OF THE INVENTION

1. Field of the Invention

The present invention generally relates to the field of joints for assemblies of planar members, and in particular, the present invention is concerned with a chair and a box having members formed from a single sheet of conventional plywood and are assembled into interlocking relationship requiring no fasteners for the assembly. The chair and box can be readily disassembled and knocked down into compact form for storage, transportation, or packaging.

2. Description of the Prior Art

Furniture of the knock down type that may be readily disassembled for storage and/or transportation or packaging has long been known. Usually the knock down furniture in the prior art employs fasteners of various types including threaded fasteners, dowels, or wedges to align and join the various parts into a completed assembly. Examples of knock down furniture using dowels, threaded fasteners, wedges, or the like in the prior art are disclosed in U.S. Pat. No.: 3,845,988; 3,870,366; and 4,140,045. U.S. Pat. No. 4,091,746 discloses a knock down article of furniture comprising components joined by tongue and groove and dovetail joints enabling the individual components to be merely pressed together to form the complete furniture article. These patents are relevant to the Applicant's invention in that they represent the closest prior art for assembling knock down furniture.

3. Prior Art Statement

The aforementioned prior art, in the opinion of the Applicant and the Applicant's Attorney represents the closest prior art of which the Applicant and his Attorney are aware.

SUMMARY OF THE INVENTION

The present invention, which will be described in greater detail hereinafter, comprises a knock down chair made from an assembly of interlocking planar members requiring no fasteners, wedges, dowels, or other devices to assemble various components of the chair into an interlocking assembly. The knock down chair of the present invention comprises a first side member and a second side member; a seat member; a pair of transverse seat support members; and a back member, with the various members cojoined into an interlocking assembly requiring no fasteners. The last member assembled, the seat, holds the entire assembly in interlocking relationship.

The pair of transverse seat support members are first rotatingly locked to the first and second side members by a pair of opposed rotatingly engageable hook flanges integral with the opposed side members. Each rotatingly engageable hook flange is rotatingly and snugly engageable with a corresponding first rectangular opening formed in each of the first and second side members. A first pair of opposed transverse flanges spaced above the pair of opposed hook flanges are integral with the transverse seat support members and are aligned and snugly engageable with a second rectangular opening formed in the first and second side members. An access opening formed in the side members is configured to accommodate a pair of opposed side member engaging openings formed along opposed outer edges of the seat member. When the opposed side member engaging openings of the seat are engaged with the side member, the pair of transverse seat support members, the first and second side members, and the seat member are in interlocking engagement.

The back member is secured to the first and second side members by a first pair of spaced apart hook flanges disposed along a first side edge of the back member and a second pair of spaced apart hook flanges disposed along a second side edge of the back member. An upper opening and a lower opening formed in the first and second side members are aligned and snugly engageable with a corresponding pair of spaced apart hook flanges which are employed to interlockingly secure the back member to the first and second side members. When the seat member is installed it abuts a downward extending flange on the back member preventing unintended disassembly of the chair.

The joints of the present invention may be employed to assemble any planar surfaces such as the walls of a box. The last wall assembled holds the other walls in place preventing unintended disassembly of the box.

It is therefore a primary object of the present invention to provide a new and improved knock down chair.

It is a further object of the present invention to provide such a knock down chair which requires no fasteners for its assembly.

It is yet another object of the present invention to provide a new and improved knock down chair having components of a planar configuration that can be formed from a standard sized sheet of plywood.

It is yet a further object of the present invention to provide a new and improved knock down chair having interlocking joints arranged to prevent an accidental disassembly of the chair.

Further objects, advantages, and applications of the present invention will become apparent to those skilled in the art of knockdown furniture when the accompanying description of one example of the best mode contemplated for practicing the invention is read in conjunction with the accompanying drawing.

BRIEF DESCRIPTION OF THE DRAWING

In the drawing, like reference numbers refer to like parts throughout the several views, and wherein:

FIG. 4 illustrates a perspective view of the hook flange of the back member;

FIG. 5 illustrates a perspective view of the lower opening formed in the side member;

FIG. 6 illustrates a perspective view of a joint for rotatingly interlocking a pair of perpendicular walls;

FIG. 7 illustrates a cross section of an alternate form of interlocking joints;

FIG. 8 illustrates a cross section of an alternate form of interlocking hook joint.

FIG. 9 illustrates an exploded view of a box using the joint of the present invention;

FIG. 10 illustrates an enlarged perspective view of an interlocking joint of the present invention;

FIG. 11 illustrates a perspective view of a chair utilizing the joint of the present invention; and FIG. 12 illustrates an enlarged broken perspective view of a joint of the present invention; and FIG. 13 illustrates an additional configuration for an interlocking hook joint.

DESCRIPTION OF THE PREFERRED EMBODIMENT

Figure 1:
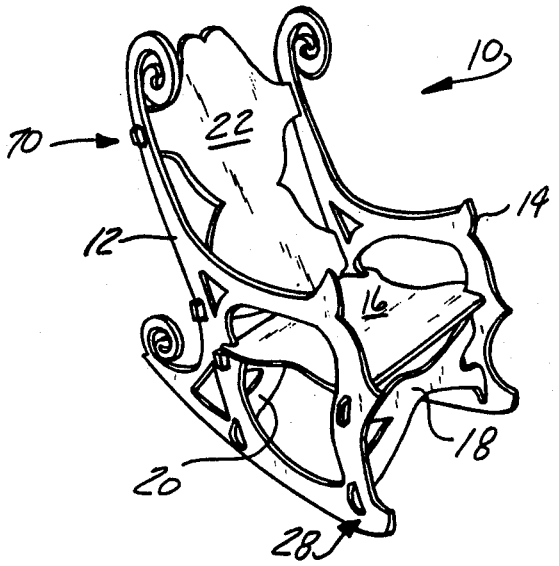
FIG. 1 illustrates a perspective view of the chair of the present invention.

Referring now to FIG. 9 of the drawing there is illustrated at 410 a knock down box for containing articles. The box 410 includes opposed top and bottom walls 412, 414 a pair of opposed sidewalls 416, 418 and a first end wall 420 and a second end wall 422. The top and bottom walls 412, 414 comprise planar members having at least one pair of opposed hooks 424 formed by a neck 426 extending outward from an edge of the planar member and a longitidunal section 428 integral with the neck spaced from the edge a distance. An end/projection 430 is formed along one end of the top and bottom wall 412, 414 and a hinged planar member 432 is hinged to another end of the top and bottom walls by a hinge 434.

Each opposed side wall 416, 418 comprises a planar member including at least one pair of opposed openings 436, 438 formed along a top and bottom edge to slidingly receive the neck 426 to interlock the top and bottom wall 412, 414 to the opposed side walls 416, 418.

The first end wall 420 comprises a planar member (FIG. 10) having a first pair of hooks 440 formed along a first side 442, and a second pair of hooks 444 formed along a second side 446. The first and second pair of hooks 440, 444 comprising an outward extending member 448 integral with the first end wall 420 and a downward extending portion 450 spaced from the first end wall to slidingly engage the sidewalls 416, 418. The side walls 416, 418 include a first upper opening 452 and a first lower opening 454 to receive the downward extending portion 450. The first lower opening 454 includes an outward extending opening 456 to snugly receive the outward extending member 448. The first end wall 420 further includes a bolt receiving means 457 for preventing the unintended disassembly of the end wall in a manner which will be described subsequently.

The second end wall 422 comprises a planar member having a third pair of hooks 458 formed along a third side 460, and fourth pair of hooks 462 formed along a fourth side 464. The third and fourth pairs of hooks 458, 462 comprising an outward extending member 466 integral with the second end wall 422 and a downward extending member or portion 468 spaced from the second end wall to slidingly engage the side walls 416, 418. The opposed side walls 416, 418 include a second upper opening 470 to receive the downward extending portion and a second lower opening 472 to receive the downward extending portion. Said second lower opening 472 including an outward extending opening 474 to snugly receive said outward extending member 466. A pair of end openings 476 are provided in the end piece 422 to slidingly receive the opposed top and bottom wall end projections 430 and prevent unintended movement of the second end wall 422.

A bolt means 478 is attached to each hinged planar member 432, with the bolt means engageable with the bolt receiving means 457 to secure the hinged planar members in a locked position and prevent unintended dissaaembly of the box.

Referring again to the drawing and in particular FIG. 1, there is illustrated at 10 another example of the present invention in the form of a knock down rocking chair. The knock down chair 10 is adapted to be made from an assembly of interlocking planar members requiring no fasteners to be assembled and includes a first side member 12 and a second side member 14; a seat member 16; a pair of transverse seat support members 18, 20 rotatingly interlocked to the side members 12 and 14; and a back member 22 interlockingly engaged with the side members 12, 14.

Figure 2:
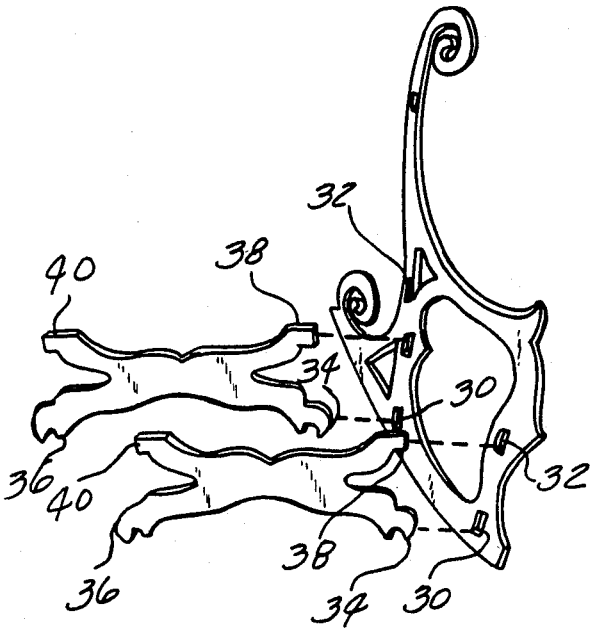
FIG. 2 illustrates a perspective view of the rotatingly engageable hook flanges of the present invention for joining the transverse seat support members to the side members.

A first locking means 28 is provided for rotatingly locking the transverse seat support members 18, 20 to the first and second side members 12, 14. The means 28 comprises a first pair of spaced apart rectangular openings 30 (FIG. 2) formed in the first and second side members 12, 14 proximate a lower edge thereof, and a second pair of spaced apart rectangular openings 32 spaced above the first pair of rectangular openings 30. A pair of opposed rotatingly engageable hook flanges 34, 36 are formed at an outer lower portion of each transverse seat support member 18, 20 with each rotatingly engageable hook flange rotatingly and snugly engageable with a corresponding first rectangular opening 30. A first pair of opposed transverse flanges 38, 40 are spaced above the pair of opposed rotatingly engageable hook flanges 34, 36 and align and are snugly engageable with its corresponding second rectangular opening. When the hook flanges 34, 36 and the opposed transverse flanges 38, 40 are engaged with the first and second rectangular openings, each transverse seat support member 18, 20 is interlocked with its corresponding side member 12, 14 and the side members are spaced apart and parallel assuming an upright position.

Figure 3:
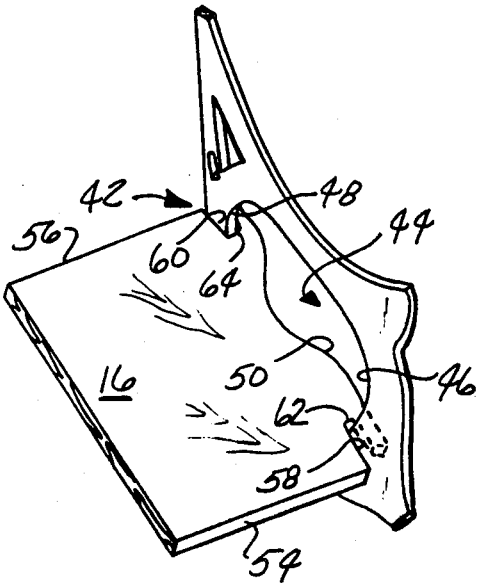
FIG. 3 illustrates a perspective view of the seat member joined to the side member.

A second locking means 42 is provided for securing the seat member 16 to the first and second side members 12, 14 in an interlocking relationship which prevents rotation of the side members relative to the transverse seat support members and a resulting disengagement of the side members form the transverse seat support members. The second locking means 42 comprises (FIG. 3) an access opening 44 having opposed front and rear edges 46, 48 formed in the first and second side members 12, 14. The seat member 16 includes opposed outer edges 50, 52 and a forward edge 54 and a rearward edge 56. A pair of opposed side member engaging openings 58, 60 are provided having open ends at the forward and rearward edges respectively. The opposed openings 58, 60 are formed inward from each of the opposed outer edges 50, 52 and are snugly engageable with the first and second side members 12, 14. Each side member engaging opening 58, 60 includes an opening inner edge 62, 64 abutting an opposed edge of the access opening 44. When the side member engaging openings 58, 60 are engaged with the side member 12, 14 the seat is supported by the transverse seat support members 18, 20 and the side members 12, 14 are held in a spaced apart parallel relationship with the seat 16 preventing rotation of the side members relative to the transverse seat support members and a resulting disengagement of the side members from the transverse seat support members.

A third locking means 70 is provided for securing the back member 22 to the first and second side members 12, 14 as illustrated in FIGS. 4 and 5. The back member 22 includes a first side edge 72 and a second side edge 74, and the third locking means 70 comprises a first pair of spaced hook flanges 76, 78 disposed along the first side edge 72, and a second pair of spaced hook flanges 80, 82 disposed along the second side edge 74. The first and second pairs of hook flanges comprise an upper portion 84 projecting outward and integral with its corresponding side edge, and an outer portion 86 extending downward from and integral with the upper portion spaced outward from its corresponding side edge. An upper opening 88 and a lower opening 90 are formed in each of the first and second side members aligned with and snugly engageable with a corresponding pair of spaced hook flanges. The lower opening 90 includes a rearward extending opening 92 in communication with the lower opening and positioned at a lower end thereof configured to snugly engage the hook flange upper portion 84. When the hook flange outer portion 86 has engaged the lower opening 90 it is then displaced downward to align the upper portion 84 with the rearward extending opening 92. The upper portion 84 is then displaced rearward to snugly engage the upper portion in the rearward extending opening interlocking the back member and its corresponding side member.

A joint 94 rotatingly interlocking a first wall 96 intersecting with a second wall 98 may be employed as illustrated in FIG. 6 of the drawing. The joint 94 comprises a rotatable hook member 100 projecting from the first wall 96 including a recess 102 having an upward extending outer wall 104, a top wall 106 perpendicular to the outer wall extending inward a distance, and an inner wall 107 extending inward and downward from the top wall. A first corner 108 is defined by an intersection of the outer wall 104 and the top wall 106, and a second corner 110 is defined by an intersection of the top wall 106 and the inner wall 107. An arcuate outside edge 112 defines an outer end of the hook member 100 and comprises an arc of constant radius having a center proximate the first corner beginning at a lower end of the outside edge and extending upward in an arcuate manner to a point vertically above the second corner 110. A hook member engaging opening 114 is formed in the second wall 98 having a width to snugly engage the rotatable hook member and a height proximate the radius of the arcuate outside edge 112. The first wall 96 and the second wall 98 are rotatingly interlocked by inserting the rotatable hook member 100 into the hook member engaging opening 114 and rotating the first wall about the center.

Another form of a rotating interlocking joint for joining a transverse seat support member 216 to a side member 214 is illustrated in FIG. 7. A blind hook flange 200 is engageable with a complementary blind aperture 214 and a blind transverse flange 238 is engageable with a complementary upper blind aperture 232 to secure the member 216 to the member 214. It is obvious to the skilled artisan that a pair of spaced blind transverse flanges 238 could also be employed to engage a pair of blind apertures 232.

FIG. 8 illustrates another form of interlocking joint that may be employed to interlock a member 316 to a side member 314 employing a hook joint 386 engaging an aperture 390. A blind lower flange 338 is engageable with a complementary blind lower aperture 332 to secure member 316 to member 314.

The various members which comprise the rocking chair 10 may be conveniently cut from a single sheet of commercially available plywood. In this manner the rocking chair 10 can be produced in a very economical low cost manner.

FIG. 11 of the drawing illustrates at 510 a knock down chair made from an assembly of interlocking planar members comprising a first side member 412 and a second side member 514, a seat member 516, a pair of transverse seat support members 518, 520, and a back member 522. The back member includes a first side edge 524 and a second side edge 526 and a downward extending lower flange 528.

A first pair of spaced apart openings 530 are formed proximate a lower edge of the first and second side members 512, 514 and a second pair of spaced apart openings 532 are spaced above the first pair of openings. A pair of rotatingly engageable hook flanges 534 are formed at an outer lower portion of each transverse seat support member 518, 520 and are rotatingly engageable with a corresponding first opening 530. A pair of opposed transverse flanges 536 are spaced above the pair of opposed rotatingly engageable hook flanges 534 and are aligned and snugly engageable with a corresponding second opening 532. The hook flange 534 and the transverse flange 536 engage the first and second openings to interlock the transverse seat support members 518, 520 with the side members 512, 514.

An access opening 538 is formed in each of the side members 512, 514 and includes a front edge 540 and a rear edge 542. The seat member 516 comprises opposed outer edges 544, a forward edge 546, and a rearward edge 548. The seat member 516 further includes a pair of opposed side member engaging hooks 550 formed along the outer edge 544 opened at the forward and rearward edges respectively formed inward from each of the opposed outer edges to snugly engage the first and second side members 512, 514 at the access opening 538.

A first pair of spaced apart hook flanges 552 are disposed along the first side edge 524, and a second pair of spaced apart hook flanges 554 are disposed along the second side edge 526 the first and second pairs of hook flanges 552, 554, as shown in FIG. 12 of the drawing, comprise and upper portion 556 projecting outward from and integral with its corresponding side edge and an outer portion 558 extending downward from and integral with the upper portion 556 and spaced outward from its corresponding side edge. An upper opening 560 and a lower opening 562 are formed in the first and second side members 512, 514 aligned with and snugly engageable with a corresponding pair of spaced apart hook flanges 552, 554. The lower opening 562 is in communication with the access opening 538 along a rear edge thereof and is sized to snugly receive the upper portion 556. When the hook flange upper portion is engaged the lower opening 562 and said seat member 516 is installed, a rear edge of the seat 564 abuts the lower flange 528 to prevent the unintended assembly of the chair.

FIG. 13 illustrates at 600 an alternate form of the hook joint shown in FIG. 7. An alternate blind hook flange 602 includes a downward and outward extending wall 604 that enters a complimentary blind recess 606 formed in an outer member 608. Placing the blind hook flange at an upper part of the assembly keeps that portion of the assembly in abutment.

It can thus be seen that the present invention has provided to a new and improved joint for knock down rocking chairs and other articles wherein the articles can be formed from components cut from commercially available plywood. It can be readily ascertained by a person skilled in the art to which this invention pertains, that many useful articles can be very economically produced by employing the teaching of the present invention.

It should be understood by those skilled in the art of knock down articles of manufacture that other forms of the Applicant's invention may be had, all coming within the spirit of the invention and the scope of the appended claims.

Having thus be described my invention what I claim is:

1. A knock down box for containing articles including opposed top and bottom walls, a pair of opposed side walls, a first end wall and a second end wall wherein:

the top and bottom walls comprise planar members, each planar member having at least one pair of hooks formed along two opposite side edges, said hooks formed by a neck extending outward from said side edge of said planar member and a longitudinal section integral with said neck spaced from the side edge, an end projection formed along one end edge of each planar member, and a hinged planar flap member hinged to another end edge of each planar member pivotable to a co-planar position with respect to said planar member;

each opposed side wall comprising a planar member including at least one pair of openings formed along a top and bottom edge to slidingly receive said neck, first and second upper apertures formed adjacent first and second end edges respectively, and first and second lower L-shaped apertures formed adjacent said first and second end edges respectively, said lower L-shaped apertures having a lower portion extending toward the adjacent end edge, said first and second upper apertures and said first and second lower L-shaped apertures spaced apart from and generally parallel to said first and second end edges respectively;

the first end wall comprising a planar member including a first pair of hooks formed along a first side edge and a second pair of hooks formed along a second side edge, said first and second pairs of hooks comprising an outward extending member integral with said first end wall and a downward extending portion spaced from said first end wall, wherein said first and second pairs of hooks slidingly engage through said first upper and lower apertures of said opposed side walls, and bolt receiving means for preventing unintentional movement of said first end wall with respect to said opposed side walls;

the second end wall comprising a planar member including a third pair of hooks formed along a third side and a fourth pair of hooks formed along a fourth side, said third and fourth pairs of hooks comprising an outward extending member integral with said second end wall and a downward extending portion spaced from said second end wall, wherein said third and fourth pairs of hooks slidingly engage through said second upper and lower apertures of said opposed side walls, a pair of end apertures formed adjacent to and spaced from a top and bottom edge to slidingly receive said opposed top and bottom wall end edge projections and prevent unintended movement of said second end wall with respect to said opposed side walls; and bolt means attached to each hinged planar flap member engageable with said bolt receiving means when said hinged planar flap member is in said co-planar position to secure said first end wall with respect to said side walls and prevent unintended disassembly of the box.

2. A knock down box made from an assembly of interlocking planar members comprising:

a pair of opposed side walls;

a pair of opposed end walls;

a bottom and an opposed top;

a first hook formed along each of two opposite side edges of the bottom and opposed top, each of said first hooks formed by a neck extending outward from the side edge of the bottom and opposed top respectively and a longitudinal section integral with said neck spaced from the side edge of the bottom and opposed top respectively;

a second hook formed as a mirror image of the first hook along each top and bottom edge of the opposed side walls at a location thereon corresponding to the location of the first hook, said second hook defining an opening to slidingly receive the first hook and interlock the opposed side walls with the bottom and top;

said pair of opposed side walls having an aperture formed adjacent each end edge and spaced apart from and parallel thereto;

a third hook formed along each of two opposite side edges of the opposed end walls at a location thereon corresponding to the location of the aperture, each of said third hooks including an outward extending member integral with each side edge of the end walls respectively and a downward extending portion spaced from each side edge of the end walls respectively, said third hook being adapted to slidingly engage through the aperture and interlock the opposed side walls with the end walls;

one of the opposed end walls having a slot formed adjacent each upper and lower edge and spaced apart from and parallel thereto;

a projection formed in one of the end edges of both the top and bottom at a location thereon corresponding to the location of the slot and adapted to engage through the slot and prevent movement of the opposed end walls; and a planar flap member pivotally attached to each of the other end edges of the top and bottom respectively, said flap members pivotable to a co-planar position with respect to the top and bottom respectively, wherein said bottom and top slide outward toward one end wall and inward toward said side walls to releasably and slidably engage said first and second hooks, said end walls being releasably locked with respect to said top, bottom, and side walls when each of said flap members is pivoted into said co-planar position.

3. The knock down box of claim 2 further comprising:

bolt receiving means formed adjacent at least one of the upper and lower edges of the other of the two opposed end walls; and bolt means mounted on each of the planar flap members at a location corresponding to the location of the bolt receiving means, said bolt means being engageable with the bolt receiving means to secure the planar members and prevent unintentional disassembly of the box.

4. The knock down box of claim 2 further comprising:

bolt receiving means formed adjacent each of the upper and lower edges of the other of the tow opposed end walls; and bolt means mounted on each of the planar flap members, said bolt means being engageable with the bolt receiving means to secure the planar members and prevent unintentional disassembly of the box.

5. A knock down box made from an assembly of interlocking planar members comprising:

a pair of opposed side walls;

a pair of opposed end walls;

a bottom and an opposed top;

a first hook formed along each of two opposite side edges of the bottom and opposed top, each of said first hooks formed by a neck extending outward from each of two opposite side edges of the bottom and opposed top and a longitudinal section integral with said neck spaced from each of the two opposite side edges of the bottom and opposed top;

a second hook formed as a mirror image of the first hook along each top and bottom edge of the opposed side walls at a location thereon corresponding to the location of the first hook, said second hook defining an opening to slidingly receive the first hook and interlock the opposed side walls with the bottom and top;

said pair of opposed side walls having an aperture formed adjacent each end edge and spaced apart from and parallel thereto;

a third hook formed along each of two opposite side edges of the opposed end walls at a location thereon corresponding to the location of the aperture, each third hook including an outward extending member integral with the side edge of the end wall and a downward extending portion spaced from the end wall, said third hook being adapted to slidingly engage within the aperture and interlock the opposed side walls with the end walls;

one of the opposed end walls having a slot formed adjacent each of the upper and lower edges spaced apart from and parallel thereto;

a projection formed in one of the end edges of both the top and bottom at a location thereon corresponding to the location of the slot and adapted to engage through the slot and prevent movement of one of the opposed end walls;

bolt receiving means formed adjacent each of the upper and lower edges of the other of the two opposed end walls;

a planar flap member pivotally attached to each of the other of the end edges of the top and bottom; and bolt means mounted on each of the planar flap members, said bolt means being engageable with the bolt receiving means when said planar flap member is in a coplanar position to secure the planar members preventing unintentional disassembly of the box.

6. A knock down box made from an assembly of interlocking planar members comprising:

a pair of opposed side walls, each side wall having a plurality of first hooks formed along a bottom edge, said first hooks formed by a neck extending outward from said bottom edge of each side wall and a longitudinal section integral with said neck spaced from said bottom edge, an upper slot-like aperture formed adjacent each end edge, said upper aperture spaced from and parallel to said end edge, and a lower L-shaped aperture formed adjacent each end edge, said lower aperture spaced from and parallel to said end edge with a lower portion of said L-shaped aperture extending outwardly toward said end edge;

first and second opposed end walls, each end wall having an upper and lower projection formed along each side edge at locations thereon corresponding to the upper and lower apertures of the side walls, said projections formed by an outward extending member integral with the side edge and a downward extending portion spaced from the side edge, the first end wall further having a slot formed adjacent the bottom edge, the slot spaced from and parallel to said bottom edge, the second wall further having bolt receiving means formed adjacent to and spaced from the bottom edge; and a bottom having a plurality of second hooks formed as mirror images of the first hooks and disposed along each side edge defining openings to slidingly receive the first hooks and interlock the opposed side walls with the bottom, a projection formed along a first end edge engageable within said slot of said first end wall, and a pivotable flap hingedly connected to a second end edge with bolt means mounted thereon engageable with said bolt receiving means when said flap is in a co-planar position relative to said bottom, wherein said upper and lower L-shaped projections of said first and second end walls engage within said upper and lower apertures of said opposed side walls, said first and second end walls slidable downward and outward to releasably lock said side and end walls together, said lower portion of said lower L-shaped apertures holding said end walls in a downward position, said projection of said bottom engageable within said slot of said first end wall as said bottom slides outward toward said first end wall and inward toward said side walls to releasably and slidably engage said plurality of first and second hooks, said first and second end walls releasably locked in an outward position when said flap is pivoted into said co-planar position allowing engagement of said bolt means into said bolt receiving means.

7. The knock down box of claim 6, further comprising:

each of said opposed side walls having a plurality of first hooks formed along a top edge;

one of said end walls having a slot formed adjacent a top edge, said slot spaced from and parallel to said top edge, and the other of said end walls having bolt receiving means formed adjacent to and spaced from a top edge; and a top having a plurality of second hooks formed as mirror images of the first hooks and disposed along each side edge defining openings to slidingly receive the first hooks and interlock the opposed side walls with the top, a projection formed along one end edge engagable within said slot, and a pivotable flap hingedly connected to another end edge with bolt means mounted thereon engageable with said bolt receiving means when said flap is in coplanar position relative to said top, wherein said projection of said top engages within said slot as said top slides outwardly toward said one end wall, and inwardly toward said side walls to releasably and slidably engage said plurality of first and second hooks, said top releasably locked in place when the said flap is pivoted into said coplanar position allowing engagement of said bolt means into said bolt receiving means.

* * * * *